United States Patent [19]

Engels et al.

[11] 4,009,700

[45] Mar. 1, 1977

[54] CONTROL ARRANGEMENT FOR THE RECONVEYANCE OF EXHAUST GASES

[75] Inventors: Uwe Engels; Günther Frohberg; Peter Klotzbach, all of Neuss; Ernst Kuhlen, Willich; Helmut Rossel, Neuss, all of Germany

[73] Assignee: A. Pierburg Autogeratebau KG, Neuss, Germany

[22] Filed: Jan. 22, 1974

[21] Appl. No.: 435,587

[30] Foreign Application Priority Data

May 10, 1973 Germany ..... 2323515

[52] U.S. Cl. ..... 123/119 A

[51] Int. Cl.[2] ..... F02B 25/06

[58] Field of Search ..... 123/119 A

[56] References Cited

UNITED STATES PATENTS

| | | | |
|---|---|---|---|
| 3,646,764 | 3/1972 | Nakajima et al. | 123/119 A |
| 3,738,342 | 6/1973 | Lewakowski | 123/119 A |
| 3,774,583 | 11/1973 | King | 123/119 A |
| 3,796,049 | 3/1974 | Hayashi | 123/119 A |
| 3,800,764 | 4/1974 | Goto et al. | 123/119 A |
| 3,800,765 | 4/1974 | Thompson | 123/119 A |
| 3,814,070 | 6/1974 | Weutheimer | 123/119 A |
| 3,835,827 | 9/1974 | Wolgemuth | 123/119 A |
| 3,842,814 | 10/1974 | Bier | 123/119 A |
| 3,888,222 | 6/1975 | Tomita | 123/119 A |

*Primary Examiner*—Wendell E. Burns
*Assistant Examiner*—David D. Reynolds
*Attorney, Agent, or Firm*—Haseltine, Lake & Waters

[57] ABSTRACT

A control arrangement for effecting the reconveyance of exhaust gas over a larger engine operating range, while concurrently constructing the control to be more sensitive and better correlated with any particular thermal and/or mechanical operating condition of the internal combustion engine. The arrangement includes a multiple-position valve located in the conducting path of the control conduit, which is so located and constructed whereby the control pressure chamber of the control pressure chambers of the adjusting device are selectively subjected to a gas pressure and/or atmospheric pressure present in the intake conduit of the internal combustion engine upstream and/or downstream of the dosing arrangement for the combustion air or, respectively, the provided fuel-air mixture, or in the path of an accumulator associated with the control conduit. The multiple-position valve itself may be constructed as an adjusting device which inherently employs, as the operating parameters, the gas pressure present in the intake conduit of the combustion engine and/or the engine speed, and/or one of the characteristic thermal or mechanical conditions of the internal combustion engines or its components. For the foregoing purpose, the multiple-position valve may be constructed, for example, as an electromagnetic valve or as a pneumatically-actuated membrane valve.

7 Claims, 11 Drawing Figures

CONTROL ARRANGEMENT FOR THE RECONVEYANCE OF EXHAUST GASES

FIELD OF THE INVENTION

The present invention relates to a control arrangement for the reconveyance of exhaust gases into the intake conduit of a gasoline or explosive internal combustion engine, in which the quantity of the reconveyed exhaust gas is influenced through an adjusting or setting device which employs as its operating parameter the gas pressure present in the intake conduit of the internal combustion engine and conveyed thereto by means of a control conduit. In order to carry out this purpose, the adjusting device includes a control membrane for controlling an adjusting element, with the membrane dividing a chamber into portions in which there is generated a differential pressure responsive to the operating parameter. Due to the reconveyance of the exhaust gas into the intake conduit there is, as is known, effected primarily a reduction in the combustion chamber temperature so as to prevent the formation of nitric oxides. Furthermore, non-combusted residual components of the exhaust gases are again reentrained for the combustion thereof.

DISCUSSION OF THE PRIOR ART

In German Laid-Open Patent Specification No. 2,034,930 there is disclosed and described a control arrangement of the above mentioned type. However, in this instance, the adjusting parameter is the quantity of the reconveyed exhaust gas. The foregoing is influenced through the intermediary of an adjusting device which utilizes, as the operating parameter, the gas pressure present upstream of the mixture dosing installation in a carburetor during idling operation, the gas pressure in the intake conduit downstream of the mixture dosing arrangement during half-load and full load operations and the mixed pressure resulting from both the above pressures during transitional operation.

The known control arranger operates exclusively within a narrowly defined range which extends for power operations of approximately slightly above idle loads to at most the intermediate operating power of the internal combustion engine. A disadvantage of the foregoing lies in that the input of the operating parameter is exclusively dependent upon the adjustment of the mixture dosing installation.

SUMMARY OF THE INVENTION

Accordingly, it is an object of the present invention to provide a control arrangement for effecting the reconveyance of exhaust gas over a larger engine operating range, while concurrently constructing the control to be more sensitive and better correlated with any particular thermal and/or mechanical operating condition of the internal combustion engine.

In an inventive manner, this object is attained in that a multiple-position valve is located in the conducting path of the control conduit, which is so located and constructed whereby the control pressure chamber or the control pressure chambers of the adjusting device are selectively subjected to a gas pressure and/or atmospheric pressure present in the intake conduit of the internal combustion engine upstream and/or downstream of the dosing arrangement for the combustion air or, respectively, the provided fuel-air mixture, or in the path of an accumulator associated with the control conduit.

Advantageously, the multiple-position valve itself may be constructed as an adjusting device which inherently employs, as the operating parameters, the gas pressure present in the intake conduit by the combustion engine, and/or the engine speed, and/or one of the characteristic thermal or mechanical conditions of the internal combustion engines or its components. For the foregoing purpose, the multiple-purpose valve may be constructed, for example, as an electromagnetic valve or as a pneumatically-actuated membrane valve.

As the operating parameters there may be considered, for example, the adjustment of the dosing installation for the combustion air (throttle valve adjustment), temperatures sensed through thermal sensors (cooling media temperature, engine temperature, ambient temperature), and the engine rotational speed recorded by an ignition impulse counter.

When the multiple-position valve is constructed as an electromagnetic valve, the operating parameters may suitably be changed into electrical quantities or impulses which, in a known manner, may then be processed by an electronic control device which converts these into electrical signals adapted for the actuation of the multiple-position valve. For this purpose there may be employed all known combinations of signal mixing and programming.

When the multiple-position valve is constructed in the form of a pneumatically-actuated membrane valve, the selection of the operating parameters is limited to the pneumatic or hydraulic flow and pressure conditions at predetermined locations in the internal combustion engine.

The adjusting element of the adjusting device may suitably be constructed of a rotationally symmetrically profiled poppet or valve cone which extends into an apertured closure. The term "valve cone" may be broadly interpreted. Thus, also spherical or approximately cylindrical poppet valve forms, and all mixtures thereof may be utilized, as well as calibrated nozzles with enlarged inlet or outlet apertures fall under the terminology "apertured closures".

A resilient or movable mounting for the valve cone is particularly suitable so as to closely fit the latter to the rim of the opening upon closing of the apertured closure.

When both operative end positions of the adjusting device equally are closure positions, then the adjusting element of the adjusting device may suitably be formed as a rotationally symmetrically profiled double-cone valve extending into an apertured closure, and whose reducing portions extend towards each other. The foregoing also applies to the adjusting element of the multiple-position valve.

The same effect is attained when the adjusting device is provided with two apertured closures which are positioned in spaced relationship above each other, and having the poppet or valve cone positioned therebetween which is preferably formed of a rotationally symmetrically profiled double-cone valve whose widening portions extend toward each other.

Generally, as a rule, the control membrane of the adjusting device is either rigidly, resiliently or pivotably connected with the valve cone, so that the control pressure chamber which is located above the control membrane is subjected to a control pressure. The reference pressure in that case is the atmospheric pressure.

The valve cone may also be formed of a plurality of components, and preferably so that in the closing position, the portion coming into contact with the rim of the apertured closure is either resiliently or pivotably arranged.

A highly sensitive control is achieved when a second control membrane is arranged at a distance from the first membrane, which is connected to the first control membrane either rigidly or through a free wheeling coupling, so that the control pressure chamber located between the membranes is subjected to the control pressure. In addition thereto, the control pressure chamber which is located above the upper control membrane may also be subjected to another control pressure.

Purposefully, each control membrane includes at least one membrane spring pretensioned in the closing direction of the adjusting device. Thus, when in the last-mentioned embodiment the control pressure chamber located between the membranes is subjected to the pressure present downstream of the dosing installation for the combustion air or, respectively, the fuel-air mixture, and the control pressure chamber located above the upper control membrane to the presssure present upstream of the mentioned dosing installation, the following advantage is obtained:

Insofar as the upper, or respectively exteriorly located control membrane has a larger active surface area than the lower, or respectively inwardly positioned control membrane, then upon an increasing pressure in the intake conduit section downstream of the dosing installation, in effect meaning at increasing engine power, an increasing exhaust gas quantity is reconveyed, since the upwardly or outwardly deflected upper or exterior membrane acting against the action of the membrane spring, as required renders operative the coupling between both membranes, and to thereby draw the dosing element into a more opened position.

The control pressure chamber located between the membranes is advantageously subjected to the pressure which is present in the intake conduit of the internal combustion engine downstream of the arbitrarily adjustable dosing installation for the combustion air, or respectively the fuel-air mixture. The control pressure chamber located above the upper or, respectively, the exterior control membrane of the adjusting device is thereby subjected to the pressure present either selectively upstream or downstream of the dosing arrangement. This arrangement has the advantage that thereby the dosing installation itself may serve as the multiple-position valve for the selective application of pressure to the control pressure chamber above the upper or exterior control membrane, so as to avoid the need for an additional multiple-position valve.

BRIEF DESCRIPTION OF THE DRAWINGS

Reference may now be had to the following detailed description of preferred embodiments of the invention, taken in conjunction with the accompanying drawings, in which.

DETAILED DESCRIPTION

Figure 1:
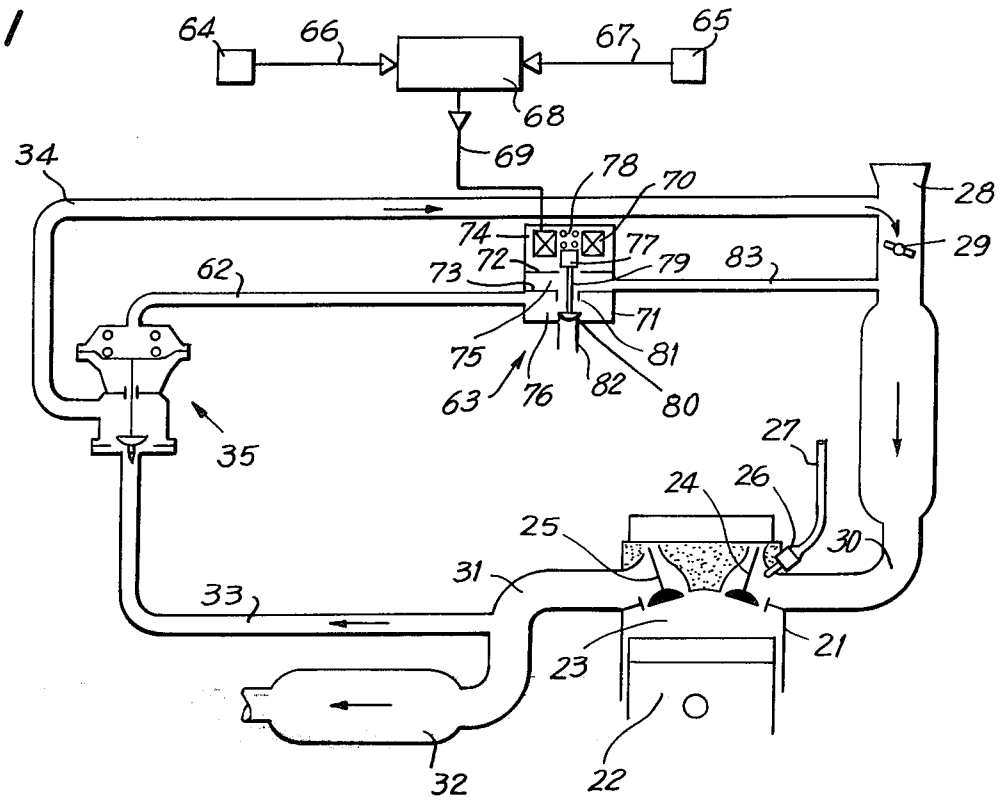
FIG. 1 is a schematic illustration of an internal combustion engine with fuel injection in the intake conduit thereof incorporating the present invention.

FIG. 1 schematically illustrates a first embodiment of the invention for an explosive or gasoline internal combustion engine including fuel injection into its intake tube.

A cylinder 21, within which there is positioned a piston 22, encloses a combustion chamber 23. Combustion mixture infeed is effected through an inlet valve 24. The exhaust gases exit from the combustion chamber 23 through an outlet valve 25.

Immediately before the inlet valve 24 there is located a fuel injection valve 26 which is supplied through a fuel conduit 27, in a known manner, with fuel.

The introduction of combustion air is effected through an air funnel 28, an arbitrarily adjustable dosing installation 29, and an intake conduit 30. The exhaust gases exit through an exhaust conduit 31, and a muffler 32 of the internal combustion engine.

By means of conduits 33 and 34, a portion of the exhaust gases are reconveyed from the exhaust conduit 31 into the intake conduit 30 upstream of the dosing installation 29.

Figure 2:
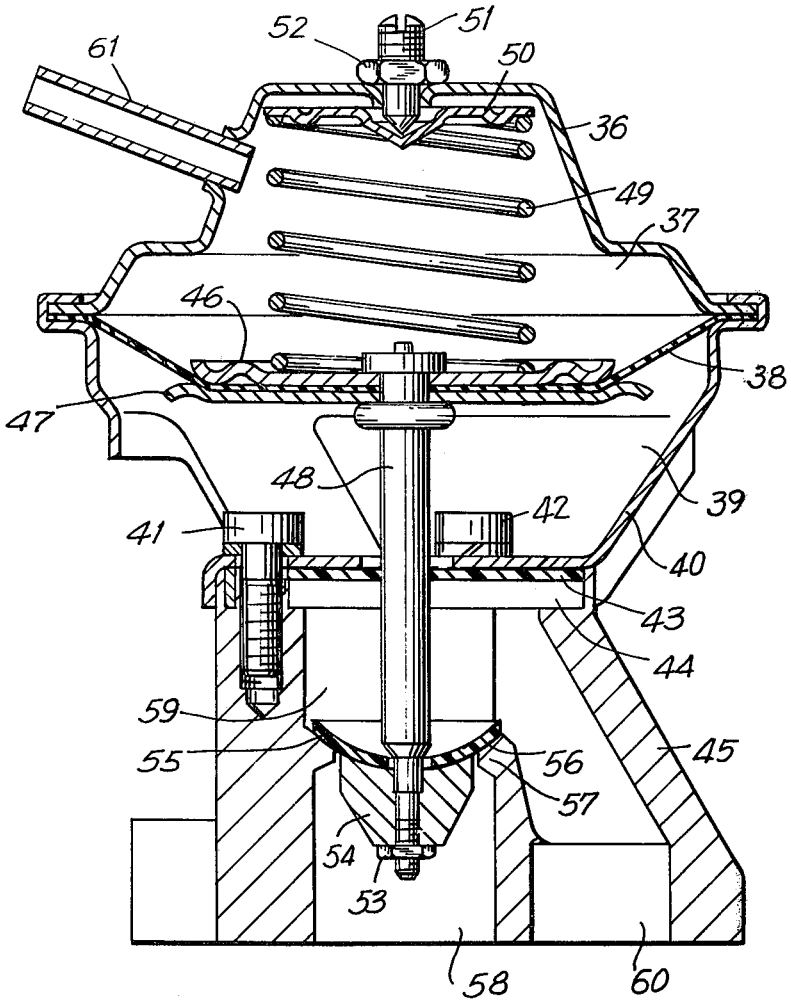
FIG. 2 is an enlarged sectional view of an adjusting device for the reconveyance of exhaust gases utilized in FIG. 1.

An adjusting device 35 is located in the flow path of conduits 33 and 34. FIG. 2 illustrates this adjusting device in a longitudinal section. A membrane housing 36 encompasses a control pressure chamber 37 which is closed downwardly thereof by a control membrane 38. Below control membrane 38 there is located a reference pressure chamber 39 which is supplied with atmospheric air, and which is encompassed by a sheet metal housing 40. The upper rim of housing 40 clampingly engages the periphery of control membrane 38 and the rim of membrane housing 36.

Through the intermediary of screws 41 and 42, sheet metal housing 40 is connected, after insertion of a seal 43 and guide plate 44, with cast iron housing 45 which serves as a valve housing.

The control membrane 38 is undetachably connected with membrane discs 46 and 47, and with a membrane actuating rod 48. Within membrane housing 37 there is located a membrane spring 49, which is downwardly supported against membrane disc 46 and upwardly against a spring contact plate 50. The pretensioning of the membrane spring 49 is set by means of an adjusting screw 51, which may be secured by a lock nut 52.

Secured to the lower end of the membrane rod 48, through the use of a nut 53, is a valve cone formed of two parts 54 and 55. The part 55 of the valve cone has a spherical or curved upper surface and is movably supported. In the closed position thereof it is adapted so closely fit against the rim 56 of a contoured aperture 57.

An inlet aperture 58 is located upstream of the valve cone, and downstream of the latter is a collection chamber 59 having an outlet aperture 60. In FIG. 1 the conduit 33 is connected with the inlet aperture 58, and the conduit 34 with the outlet aperture 60.

In accordance with FIG. 1, from conduit connectors 61 of the membrane housing 36, a control conduit 62 leads to a multiple-position valve 63. The multiple-position valve itself is formed as an electromagnetically actuated adjusting device. The operating parameters therefore are provided by the thermal characteristics received by the thermal sensor 64, and the characteristic mechanical condition received by the switch 65 (for example, the setting of the dosing installation 29) of the internal combustion engine.

The operating parameters which are changed into electrical quantities or impulses are further transmitted through electrical conduits 66 and 67 to an ultronic control device 68, processed therein, and then converted into electrical signals suitable for the actuation of the multiple-position valve 63. The electrical signals are transmitted through an electrical conduit 69 to an induction coil 70 of multiple-position valve 63.

The multiple-position valve 63 includes a housing 71 which is divided into three chambers 74, 75 and 76 by separating walls 72 and 73. The induction coil 70 is a cylindrical coil which is positioned in chamber 74. Interiorly of the coil there is located a magnetic armature 77 which, upon excitation of the induction coil 70, is drawn inwardly of the coil against the force of a spring 78.

A valve rod 79 is fastened to the magnetic armature 77, supporting a valve plate 80 at its lower end. The valve rod 79 in a gastight manner extends through the separating wall 72 and, in a not gastight manner extends through the conduit connection 81 in the separating wall 73.

In the at-rest position, the valve plate 80 closes the outwardly leading conduit connection 82. This forms a connection from the intake conduit 30 from the region downstream of the dosing installation 29 to the control pressure chamber 37 of the adjusting device 35 through the control conduit 83, chamber 75, conduit connection 81, chamber 76 and control conduit 62.

The signal processing of the electronic control device 68 is so arranged that only during partial load operation are no electrical signals transmitted to the multiple-position valve 63, so that only during partial load operation the control membrane of the adjusting device 35 is subjected to the gas pressure which is present downstream of the dosing installation 29. Since this gas pressure lies below atmospheric pressure, the control device 35 is more or less opened and a portion of the exhaust gases flows through the conduits 33 and 34 from the exhaust conduit 31 back into intake conduit 30 above the dosing installation 29. Through switch 65 there is thereby provided a watch over the setting of the dosing installation 29 forming the characteristic mechanical condition of the internal combustion engine.

On the other side, also at a cold internal combustion engine the adjusting device 35 should remain closed independently of the setting of the dosing installation 29. This is attained in that the electronic control device 68 blocks the signals emanating from the switch 65 for so long a period until the thermal sensor 64 signals the exceeding of a minimum temperature.

Figure 3:
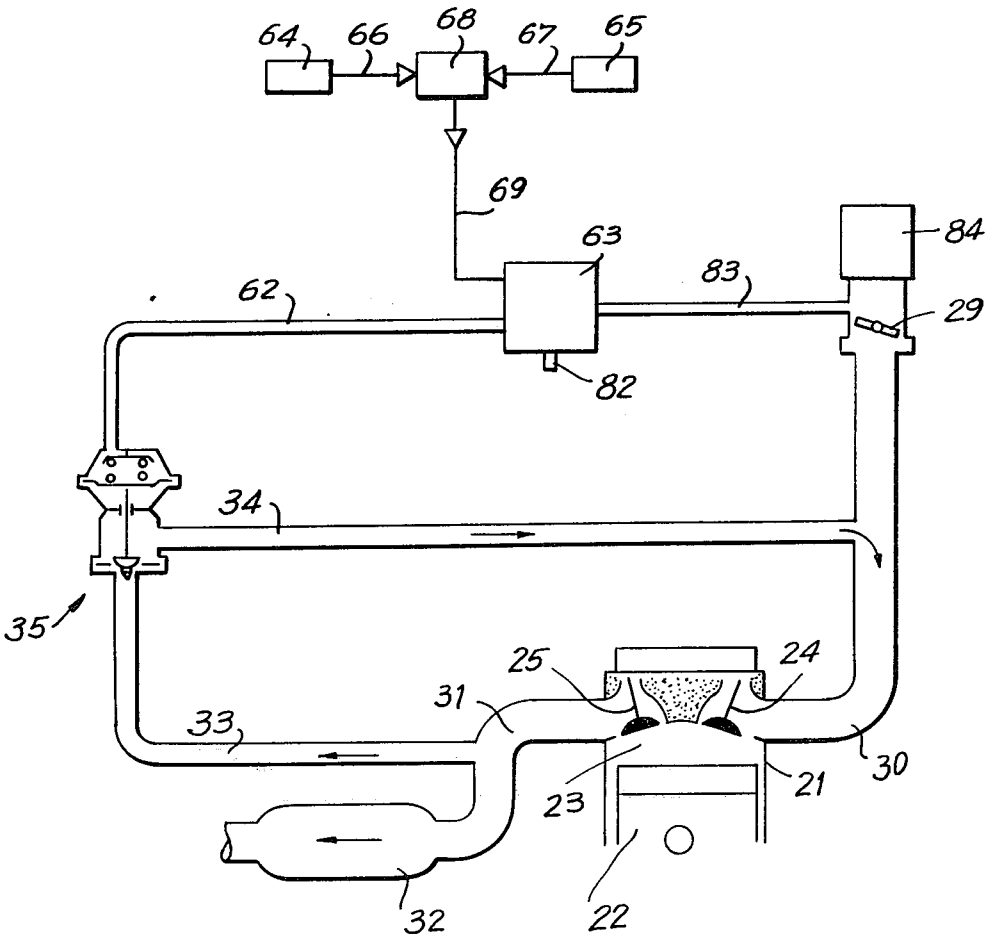
FIG. 3 is a schematic illustration similar to FIG. 1 showing a second embodiment of the invention.

FIG. 3 schematically illustrates another embodiment of the invention as applied to an internal combustion engine with a carburetor.

The cylinder 21, in which the piston 22 is located, encompasses the combustion chamber 23. The mixture infeed is effected through an inlet valve 24. The exhaust gases exit through an outlet valve 25 of the combustion chamber 23.

The forming of the mixture is carried out in the carburetor 84. The mixture quantity is measured in through the arbitrarily adjustable dosing installation 29. The mixture is conveyed into the internal combustion engine through the intake conduit 30. The exhaust gases exit the internal combustion engine through the exhaust conduit 31 and muffler 32.

A portion of the exhaust gases are reconveyed into the intake conduit 30 from exhaust conduit 31 through conduits 33 and 34, downstream of the dosing installation 29.

Within the flow path of conduits 33 and 34 there is located the adjusting device 35, which is described in greater detail in FIG. 2 of the drawings. A control conduit 62 leads from the membrane housing of the adjusting device 35 to a multiple-position valve 63, the details of which are more closely described in FIG. 1. The multiple-position valve 63 itself is an electromagnetically actuated adjusting device. The operating parameters thereof are provided by a thermal sensor 64 receiving the thermal characteristics and a switch 65 receiving the mechanically characteristic condition of the internal combustion engine.

The operating parameters which have been changed into electrical quantities or impulses are further transmitted into an electronic control device 68 through electrical conduits 66 and 67, processed therein, and then converted into electrical signals suitable for the actuation of the multiple-position valve 63, which are transmitted to the multiple-position valve 63 through the electrical conduit 69.

The signal processing by the electronic control device 68 is, in connection with the switching and arrangement of the multiple-position valve 63, so arranged that the control conduit 62 is during idle operation, above the upper partial load region and during full load operation vented through the outwardly leading conduit connection 82. The adjusting device 35 thereby remains closed, and reconveyance of the exhaust gases is interrupted. Only during partial load operation does the switch 65 emanate the required signals for the release of the control conduit 83 and the closing of the conduit connection 82. The signals emanating from the switch 65 are blocked in the electronic control device 68 for so long until the thermal sensor 64 signals the exceeding of a minimum temperature. This allows that, for a cold internal combustion engine, the adjusting device 35 remains closed independently of any of the characteristic mechanical conditions of the internal combustion engine.

Figure 4:
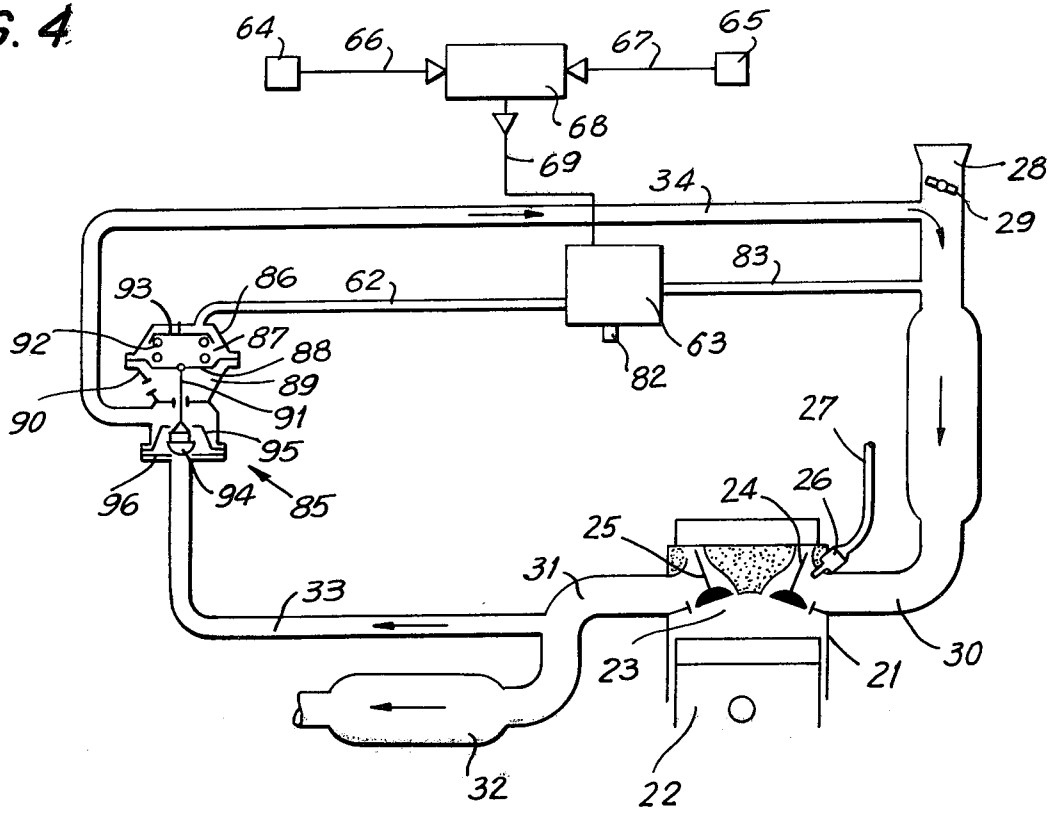
FIG. 4 is a schematic illustration similar to FIG. 1 showing a third embodiment of the invention.

In FIG. 4 there is illustrated an alternative embodiment of the invention as compared to FIG. 1. In this instance the invention also relates to an explosive or gasoline internal combustion engine provided with fuel injection. The individual components and their functions are described in greater detail hereinabove with respect to FIG. 1 of the drawings.

Deviating from the embodiment pursuant to FIG. 1, herein the reconveyance of the exhaust gases is effected downstream of the arbitrarily adjustable dosing installation 29. Furthermore, the adjusting device 85 also deviates from the adjusting device 35 illustrated in FIG. 1. A membrane housing 86 encompasses the control pressure chamber 87, the latter of which is downwardly closed by means of control membrane 88. Below the control membrane 88 there is located an atmospherically vented reference pressure chamber 89 which is enclosed by a sheet metal housing 90.

The control membrane 88 is connected with the membrane rod 91. Interiorly of membrane housing 86 there is located a membrane spring 92 which is downwardly supported against the control membrane and upwardly against an adjustable spring contact plate 93. Fastened to the lower end of the membrane rod 91 is a rotationally symmetrically profiled double-cone valve 94, whose widening portions extend towards each other. The double-cone valve 94 is located between apertures 95 and 96 so that, in its lower at rest position, it closes valve aperture 96, while in the intermediate position thereof both apertures are opened, and in the upper operative position thereof the aperture 95 is closed.

The signal processing of the electronic control device 68 is, in connection with the switching and arrangement of the multiple-position valve 63 so located that the control conduit 62 is during idle operation, above the upper partial load operation and during the full load operation vented through the outwardly leading conduit connection 82. The double-cone valve 94 thereby closes the aperture 96, and the reconveyance of exhaust gas is interrupted.

Only during partial load operation does the switch 65 provide the required signals for the opening of the control conduit 83 and the closing of the conduit connection 82. At this time, the pressure in the intake conduit 30 is so low as to be capable, in the control pressure chamber 87, to more or less raise the control membrane 88 against the force of the membrane spring 92 whereby the double-cone valve 94 opens the aperture 96. The pressure is, however, not sufficiently low in order to displace the control membrane into the position whereby the double-cone valve is raised to the extent for closing the aperture 95.

During the transistion from idle to partial load operation, the pressure in the intake conduit 30 is sufficiently low to raise the control membrane to the extent to which the double-cone valve 94 next also closes the aperture 95 and then increasingly opens.

Upon the sudden acceleration sequences, the arbitrarily adjustable dosing installation 29 is suddenly opened. Consequently, the pressure in the intake conduit 30 increases to such an extent that the double-cone valve 94 closes the aperture 96 so that, as a desired effect, the reconveyance of the exhaust gas during the acceleration sequence is interrupted. Also herein the signals emanating from the switch 65 are blocked in the electronic control device 68 for so long until the thermal sensor 64 signals the exceeding of a minimum temperature, so that the reconveyance of the exhaust gas only commences with a sufficiently warmed up internal combustion engine.

Figure 5:
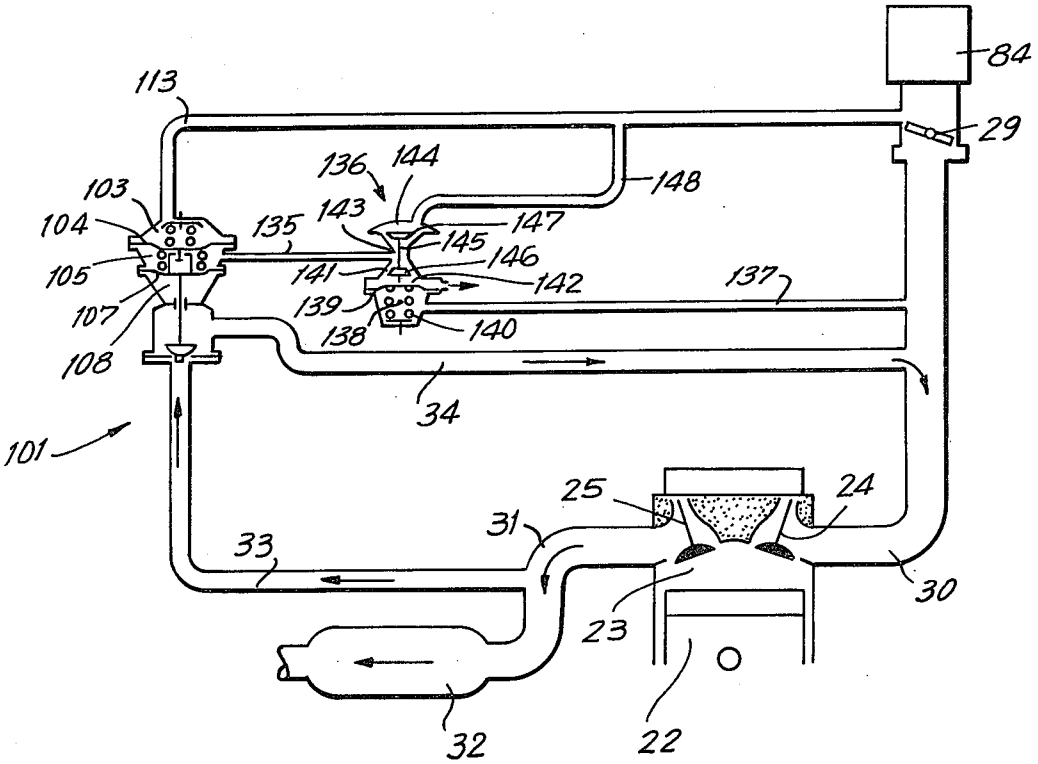
FIG. 5 is a schematic illustration similar to FIG. 3 showing a fourth embodiment of the invention.

FIG. 5 illustrates an embodiment of the invention deviating from FIG. 3. Also in this instance, the invention is utilized in connection with an internal combustion engine with a carburetor. The components of the internal combustion engine are, as hereinabove described in FIG. 3.

Figure 6:
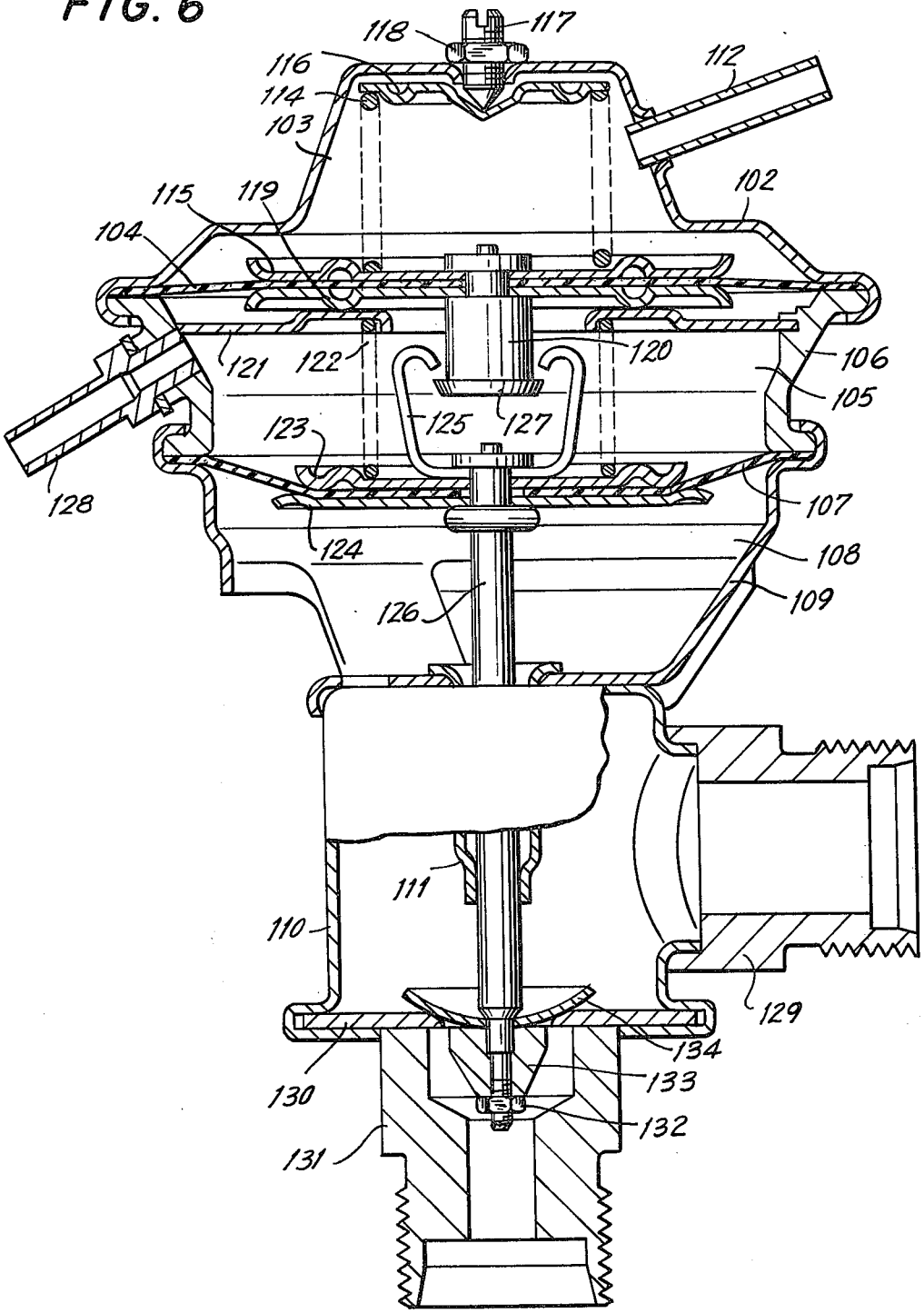
FIG. 6 is an enlarged sectional view of an inventive adjusting device utilized in the engine shown in FIG. 5.

Located in the flow path of conduits 33 and 34 is an adjusting device 101 which is described in greater detail in FIG. 6. Pursuant to FIG. 6, a membrane housing 102 encompasses a control pressure chamber 103 which is downwardly closed off by a control membrane 104. Below the control membrane 104 there is located a control pressure chamber 105 which is enclosed by a cast iron housing 106. The control pressure chamber 105 is downwardly sealed off through the intermediary of a second control membrane 107. Below the control membrane 107 is located an atmospherically aired reference pressure chamber 108, which is encompassed by a sheet metal housing 109.

The upper rim of the sheet metal housing 109 clampingly engages the periphery of control membrane 107 and the lower rim of cast iron housing 106. The rim of membrane housing 102 clampingly engages the periphery of control membrane 104 and the upper rim of the cast iron housing 105. The control membrane 104 has a larger active surface area than the control membrane 107.

The sheet metal housing 109 is connected with a valve housing 110. A guide sleeve 111 is positioned at the connecting location.

The membrane housing 102 includes a conduit connection 112 for connection of the control conduit 113 (pursuant to FIG. 5). Interiorly of the membrane housing 102 there is provided a membrane spring 114 which is downwardly supported against a membrane disc 115 and upwardly against a spring contact plate 116. The pretensioning of the membrane spring 114 is set by means of an adjusting screw 117, which is adapted to be secured by a lock nut 118.

The control membrane 104 is undetachably connected with the membrane discs 115 and 119, and with a coupling member 120. The spring contact plate 121 is secured in the upper portion of the cast iron housing 106, against which the membrane spring 122 is supported, and which serves concurrently as the lower contact for the membrane disc 119.

The control membrane 107 is undetachably connected with the membrane discs 123 and 124, with the coupling member 125 and the membrane rod 126. The coupling member 125 so extends beyond the projecting rim 127 of the coupling member 125 in a hooked engagement, so that both coupling members are separated in the at rest position. As soon as a lower pressure then atmospheric pressure reigns in the control pressure chamber 103, the control membrane 104 is raised in opposition to the force of membrane spring 114 whereby, after passing through a free distance, the coupling member 120 takes along the coupling member 125 and also the membrane rod 126, as long as there does not reign a lower pressure in the control pressure chamber 105, since through the connection 128 there is introduced a control pressure which lies below atmospheric pressure.

The valve housing 110 supports at its side an outlet connector 129. The lower rim of the housing extends about an aperture 130, having concurrently an inlet connector 131 fastened thereto.

To the lower end of the membrane rod 126 is fastened a valve cone, which is formed of two portions 133 and 134, by means of nut 132. The valve cone portion 134 is formed with a spherical or curved upper surface and is movably supported. In the closed position it closely fits against the inner edge of the contoured aperture 130.

A control conduit 135 leads from the connector 128 of the control pressure chamber 106, as shown in FIG. 5, to the multiple-position valve 136. The multiple-position valve itself is formed as a pneumatically actuated adjusting device. The operating parameters therefor are provided by the pressure reigning in the intake conduit 30, which comes into effect in the control pressure chamber 138 through the control conduit 137. The control pressure chamber 138 is upwardly sealed by a control membrane 139, which is preloaded through the adjustably pretensioned membrane spring 140.

The housing 141 of the multiple-position valve 136 is divided into three further chambers, namely, the atmospherically vented reference pressure chamber 142, the mixed pressure chamber 143 and the vacuum chamber 144.

The control membrane 139 is connected with a membrane rod 145, onto which there are fastened two valve cones. The valve cone 146 is so located as to close the reference pressure chamber 142 with respect to the mixed pressure chamber 143 in the at-rest position. The valve cone 147 in contrast therewith is so located, that at in the at rest position the vacuum chamber 144 is connected with the mixed pressure chamber 143.

The foregoing forms a connection in the region upstream of the closed dosing installation 29 to the control pressure chamber 105 of the adjusting device 101 through the control conduits 113 and 148, the vacuum pressure chamber 144, the mixed pressure chamber 144 and the control conduit 135.

As soon as the pressure in the control pressure chamber 138 of the multiple-position valve 136 is sufficiently small, the control membrane 139 draws the valve cone 147 into its closing position and the valve cone 146 into its opening position. Thereby, the vacuum chamber 144 is closed off with respect to the mixed pressure chamber 143, and there is formed a connection with atmosphere to the control pressure chamber 105 of the adjusting device 101 through the operating pressure chamber 142, the mixed pressure chamber 143, and the control conduit 135.

These variants of the invention each afford a finely stepped, and to the operating conditions of the internal combustion engine correlated reconveyance of the exhaust gases without the need for secondary electrical energy or auxiliary apparatus.

During the idle operation of the engine the dosing installation 29 is almost closed. The mouth of the control conduit 113, however, still lies upstream of the dosing installation 29. A pressure reigns therein at this time which is only slightly below atmospheric pressure. This relatively high pressure comes into effect in the control pressure chamber 103 of the adjusting device 101 so as to restrain the control membrane 104 in its lower at-rest position. In contrast, downstream of the dosing installation 29 there reigns a relatively low pressure, which through the control conduit 137 so comes into effect in the control pressure chamber 138 of the multiple-position valve 136 to thereby position the valve cone 147 in its closing position and valve cone 146 in its opening position. Consequently, this proforms a connection with atmosphere to control pressure chamber 105 adjusting device 101 through the reference pressure chamber 142, the mixed pressure chamber 143, and the control conduit 135. In this case, the second control membrane 107 is also located in its lower at rest position, and the adjusting device 101 is closed.

During the lower part-load operation of the engine, the dosing installation 29 is opened to such an extent whereby that the mouth of the control conduit 113 lies downstream of the dosing installation. This causes a lower pressure to come into effect in the control pressure chamber 103 of the adjusting device 101, which is, however, already higher than the pressure present in the intake conduit 30 during the idle operation of the engine.

This pressure also so comes into effect in the control pressure chamber 138 of the multiple-position valve 136, so that the valve cone 147 is placed into its closed position. In that manner venting of the control pressure chamber 105 is achieved.

The reduced pressure or vacuum which is present in the control pressure 103 causes the control membrane 104 to be raised so far until the membrane disc 115 comes into contact with the surface of the membrane housing 102. Through the intermediary of coupling 120 and 125, the membrane rod 126 and therewith its two-part valve cone are correspondingly lifted, so as to initiate a restricted exhaust gas return flow. (Position I of the adjusting device 101).

During the upper part-load operation of the engine, the dosing installation 29 is still further opened. Thereby the pressure in the intake conduit 30 increases so far, that the force of membrane spring 140 overcomes the control pressure acting on the control membrane 139 of the multiple-position valve 136, and moves the valve cone 146 into its closed position. This forms a connection between the intake conduit 30 and the control pressure chamber 105 of the adjusting device 101 through the control conduits 113 and 148, the vacuum chamber 144, the mixed pressure chamber 143, and the control conduit 135. The control pressure present in control pressure chamber 105 is, in comparison with atmospheric pressure, still sufficiently low so as to further more or less raise the control membrane 107, whereby the two-part valve cone can attain its maximum opening position. (Postion II of the adjusting device 101). Herein the control membrane 104 is located in its lowest at-rest position inasmuch as it is subjected to a control pressure of equal intensity on both sides thereof.

During the full-load operation of the engine, the pressure in the suction conduit increases still further. The pressure differential with respect to atmospheric pressure is now so low that the force of the membrane spring 122 overcomes the control pressure acting on the control membrane 107 of the adjusting device 101, whereby the control membrane 107 is located in its lower at-rest position, and the valve cone portion 134 in its closed position. Exhaust gas reconveyance now is no longer possible.

The transition from idle operation through lower and upper part-load operation to full-load operation, and reversely, flows smoothly and similarly, the corresponding control of the reconveyed exhaust gas quantity becomes smooth.

Figure 7:
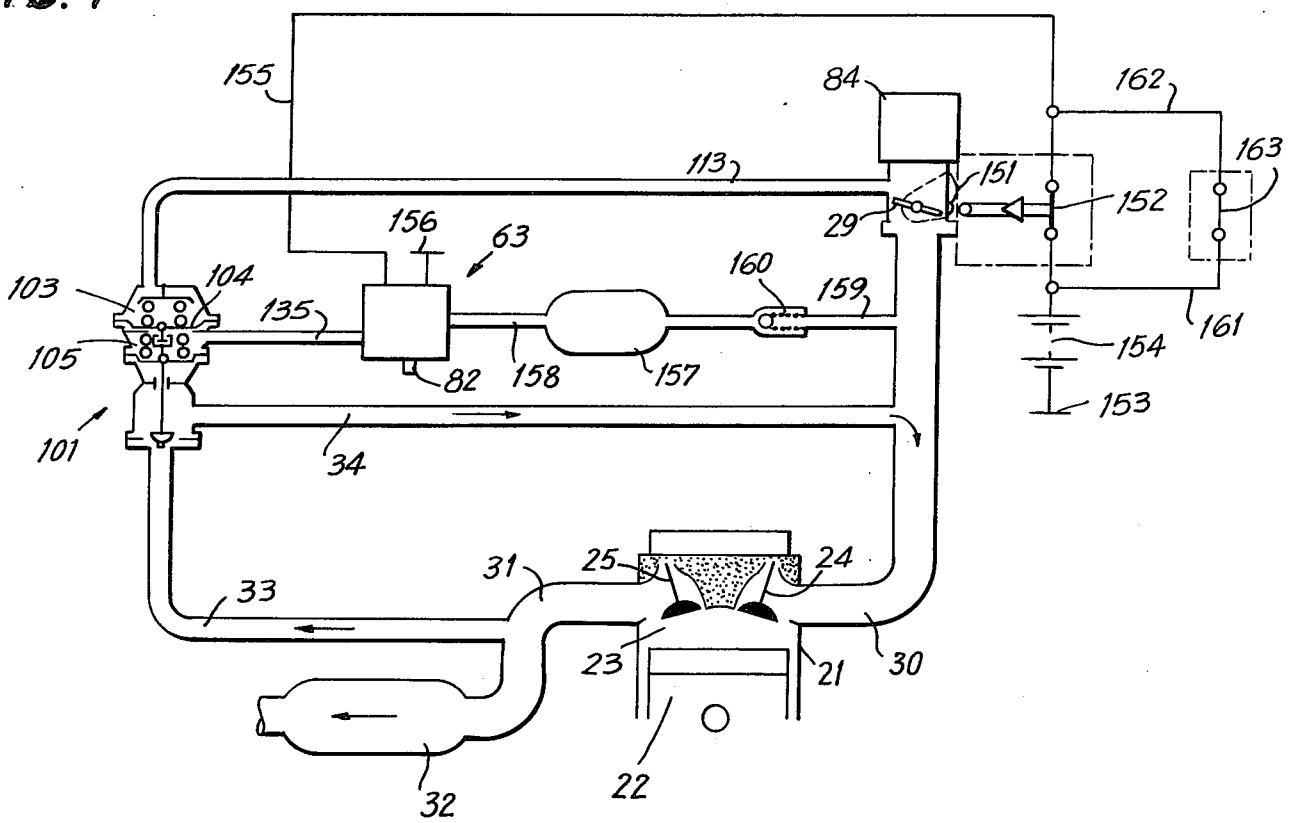
FIG. 7 is a schematic illustration similar to FIG. 5 showing a fifth embodiment of the invention.

An inventive variant of an embodiment differing somewhat from that in FIG. 5 is illustrated in FIG. 7 of the drawings.

This variant also pertains to an embodiment of the invention for use in an internal combustion engine with a carburetor. The elements of the internal combustion engine are hereinabove described in detail with respect to FIG. 3. The adjusting device 101 is selected pursuant to the embodiment of FIG. 6, and the multiple-position valve 63 is constructed pursuant to FIG. 1.

As in FIG. 5, also in this instance a control conduit 113 leads from the control pressure chamber 103 to the region immediately upstream of the closed dosing installation 29. Deviating from the embodiment of FIG. 5, the control conduit 135 leads from the control pressure chamber 105 to an electromagnetically actuated multiple-position valve 63. A plate cam 151 is fastened to an actuating shaft of the arbitrarily adjustable dosing installation 29, so as to control an electrical switch 152 which, as illustrated, is closed in the closed or almost closed position of the dosing installation 29. The actuating current circuit is closed by a ground connection 153 through storage batteries 154, switch 152, the conduit 155, the actuating coil (not shown) of the multiple-position valve 63, and the ground connection 156, so that the vented connector 82 is connected with the control conduit 135, and the control conduit 158 leading from the storage 157 is closed thereagainst. Since atmospheric pressure now reigns in the control pressure chamber 105, the adjusting device 101 remains closed. This is the case, for example, during engine idle operation, since at that time, also through the control conduit 113 there is conveyed a pressure into control pressure chamber 103 which deviates only slightly from atmospheric pressure.

During the lower part-load operation of the engine, the dosing installation 29 is opened to the extent whereby the mouth of the control conduit 113 lies downstream of the dosing installation 29. Thereby, in the control pressure chamber 103 of the adjusting device 101 only a relatively low pressure comes into effect. Accordingly, the control membrane 104 is raised so far as to initiate a restricted exhaust gas reconveyance. (Position I of the adjusting device 101). The switch 152 is still closed during lower part-load engine operation.

During the upper part-load engine operation, the dosing installation 29 is opened further. The plate cam 151 now has opened the switch 125 so that the actuating coil of the multiple-position valve 63 is without current. This effects the closing of the conduit connection 82 and the connection of the control conduit 158 with the control conduit 135. The stored vacuum caused by the return valve 160 located in the control conduit 159 upstream of the accumulator 157 comes into effect in the control pressure chamber 105, which results in that the valve cone is drawn into its maximum opening position. (Position II of the adjusting device 101).

During the full-load engine operation, the adjusting device 29 is opened so far, that the plate cam 151 again releases the switch 152, which then automatically closes. As soon as the current circuit is closed, the control pressure chamber 105 is again vented through the intermediary of the multiple-position valve 63. Since also the pressure in the intake conduit 30, and thereby in the control pressure chamber 103 has risen so far that the force of the membrane spring overcomes the control pressure acting on the control membrane 104 of the adjusting device 101, the valve cone moves into its closing position.

In parallel to the switch 152, the thermal switch 163 is switched through conduits 161 and 162. The thermal switch first opens when the internal combustion engine exceeds a predetermined, previously set temperature. This provides for that the exhaust gas reconveyance is only initiated when the internal combustion engine has been sufficiently prewarmed.

Figure 8:
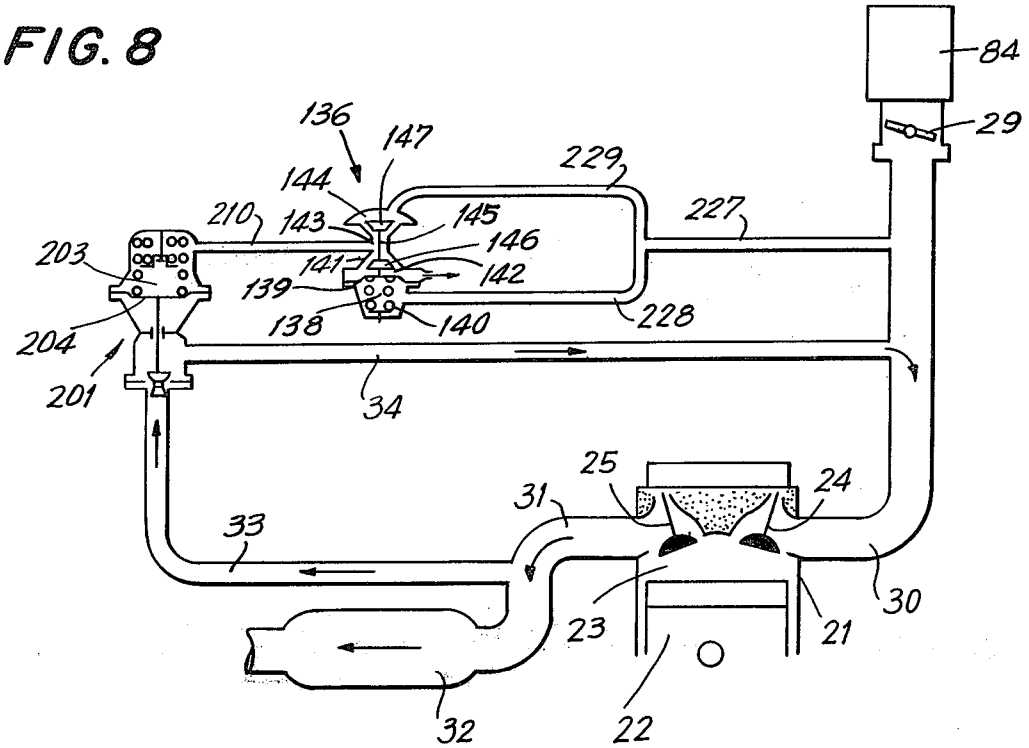
FIG. 8 is a schematic illustration similar to FIG. 5 showing a sixth embodiment of the invention.

A variation of the embodiment of FIG. 5 of the invention is illustrated in FIG. 8. Also in this instance the invention is described with reference to an internal combustion engine which is provided with a carburetor, whose components are described hereinabove with reference to FIG. 3 of the drawings.

Figure 9:
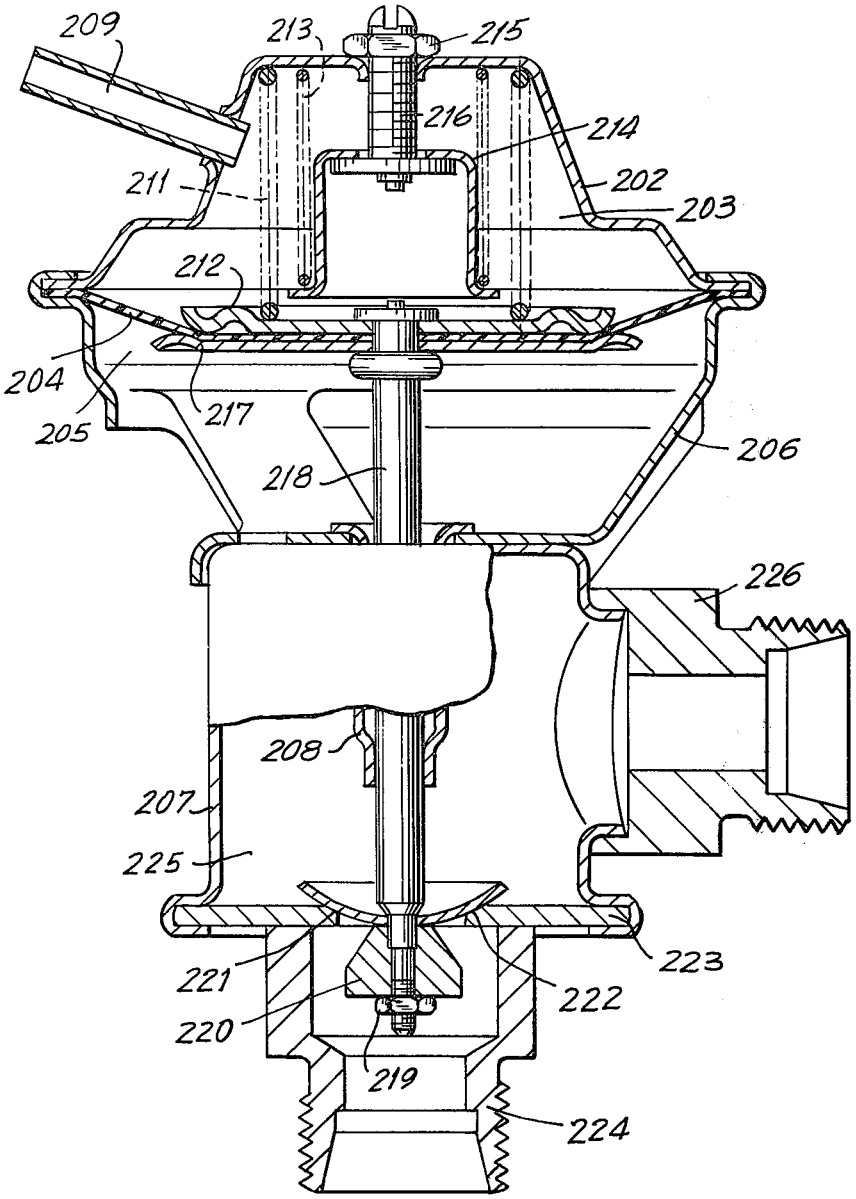
FIG. 9 is an enlarged sectional view of an inventive adjusting device utilized in the engine shown in FIG. 8.

Within the flow path of conduits 33 and 34 there is located an adjusting device 201 which is described in greater detail in FIG. 9. Pursuant to FIG. 9, a membrane housing 202 encompasses a control pressure chamber 203 which is downwardly closed by means of a control membrane 204. Below the control membrane 204 there is located an atmospherically vented operating pressure chamber 205 which is encompassed by a sheet metal housing 206. The upper rim of the sheet metal housing 206 clampingly engages the periphery of the control membrane 204, and the rim of membrane housing 202.

The sheet metal housing 206 is connected with the valve housing 207. A guide sleeve 208 is located at the connecting juncture.

The membrane housing 202 includes connector 209 for the connection of a control conduit 210, as shown in FIG. 8. Interiorly of the membrane housing 202 there are positioned two concentrically located membrane springs. The membrane spring 211 is downwardly supported against a membrane disc 212 and upwardly against the surface of membrane housing 202. The inner membrane spring 213 is downwardly supported against the spring contact plate 214 and upwardly, similarly, against the surface of membrane housing 202. The height position of the spring contact plate 214 is adjustable by means of a screw 216 which is secured by a lock nut 215.

As soon as a control pressure reigns in the control pressure 203 which is below atmospheric pressure, the force of membrane spring 211 is overcome until the membrane disc 212 contacts the spring contact plate 214. Upon further dropping of the control pressure, there must additionally be overcome the force of the second membrane spring 213 if the control membrane 204 is to be moved further upwardly.

The control membrane 204 is undetachably connected with the membrane discs 212 and 217, and with the membrane rod 218. The lower end of the membrane rod 218, by means of a nut 219, has fastened thereto a valve cone constructed of two portions 220 and 221. The valve cone portion 221 is herein provided with a spherical or curved upper surface and is movably supported. In the closed position it fits precisely against the edge 222 of an aperture 223.

Upstream of the valve cone there is located an inlet connector 224, downstream is the collection chamber 225 and the outlet connector 226, onto which there is connected the conduit 34, pursuant to FIG. 8.

The control conduit 210 leads from contact connector 209, as shown in FIG. 8, to the multiple-position valve 136. The multiple-position valve itself is formed as a pneumatically-actuated adjusting device. The operating parameter therefor is the pressure present in the intake conduit 30 of the internal combustion engine, which comes into effect in the control pressure chamber 138 through the control conduits 227 and 228. The control pressure chamber 138 is upwardly closed by means of control membrane 139, which is preloaded by means of an adjustably pretensioned membrane spring 140.

The housing 141 of the multiple-position valve 136 is divided into three further chambers, namely, the atmospherically vented reference pressure chamber 142, and the mixed pressure chamber 143, and the vacuum chamber 144.

The control membrane 139 is connected with the membrane rod 145, onto which there are fastened two valve cones. The valve cone 146 is so located that in its at-rest position it closes the reference pressure chamber 142 with respect to the mixed pressure chamber 143. The other valve cone 147 in contrast therewith is located so that in its at-rest position, the vacuum chamber 144 is connected with the mixed pressure chamber 143. This forms a connection between the intake conduit 30 and the control pressure chamber 203 of the adjusting device 201 through the control conduits 227 and 229, the vacuum chamber 144, the mixed pressure chamber 143, and the control conduit 210.

As soon as the pressure in the control pressure chamber 138 of the multiple-position valve 136 is sufficiently low, the control membrane 139 draws the valve cone 147 into its closing position and the valve cone 146 into its opening position. Thereby, the vacuum chamber 144 is closed with respect to the mixed pressure chamber 143, and a connection is formed between atmosphere and the control pressure chamber 203 of the adjusting device 201 through the reference pressure chamber 142, the mixed pressure chamber 143, and the control conduit 210.

These variants of the invention have, in comparison with FIG. 5, the advantage of greater simplicity. During the idle operation of the engine, the dosing installation 29 is almost closed. Consequently, a relatively low pressure reigns in the intake conduit 30 which through control conduits 227 and 228 comes into effect in the control pressure chamber 138 of the multiple-position valve 36, whereby the valve cone 147 is moved into its closing position and the valve cone 146 into its opening position. This forms a connection between atmosphere and the control pressure chamber 203 of the adjusting device 201 through the reference pressure chamber 142, the mixed pressure chamber 143, and the control conduit 210. This positively locates the control membrane 204 into its lower at-rest position, and the adjusting device 201 is closed.

During the lower part-load engine operation, the control pressure effective in the control pressure chamber 138 is not quite as low as during engine idle operation, whereby the valve cone 147 of the multiple-position valve 146 is located in its opening position, and the valve cone 146 in its closing position.

In the mixing pressure chamber 143 there reigns now the pressure of the intake conduit 30 which comes into effect in the control pressure chamber 203 of the adjusting device 201 through the control conduit 210. This pressure is sufficiently low in order to lift the control membrane 204 to an extent whereby its membrane disc 212 comes into contact with the surface of the membrane housing 202. Correspondingly, the valve cone is adjusted (Position I of the adjusting device 201).

During the upper part-load engine operation, the dosing installation is opened still further. Consequently, the pressure in the intake conduit 30 increases so far that the membrane plate 212 just against the force of membrane spring 211 lies against the rim of spring contact plate 214. Correspondingly, the valve cone is moved to an intermediate position so as to free a larger flow cross-section. (Position II of the adjusting device 201).

During the full-load engine operation, the pressure differential between the pressure in the control pressure chamber 203 and the atmospheric pressure acting on the control membrane 204 is inadequate to exceed the force of membrane spring 211. Consequently, the adjusting device 201 is moved into its closed position. The transition from one engine operating range to another is accomplished smoothly. However, if the dosing installation 29 is suddenly opened from its idle position for acceleration, the pressure in the intake conduit similarly increases quite suddenly, which has the result that the control membrane 139 moves valve cone 146 into its closing position and valve cone 146 into its opening position, so that the effectively increased, but still not at the height of atmospheric pressure located control pressure, effects the lifting of the control membrane 204 and the movement of the adjusting device 201 to Position I.

Figure 10:
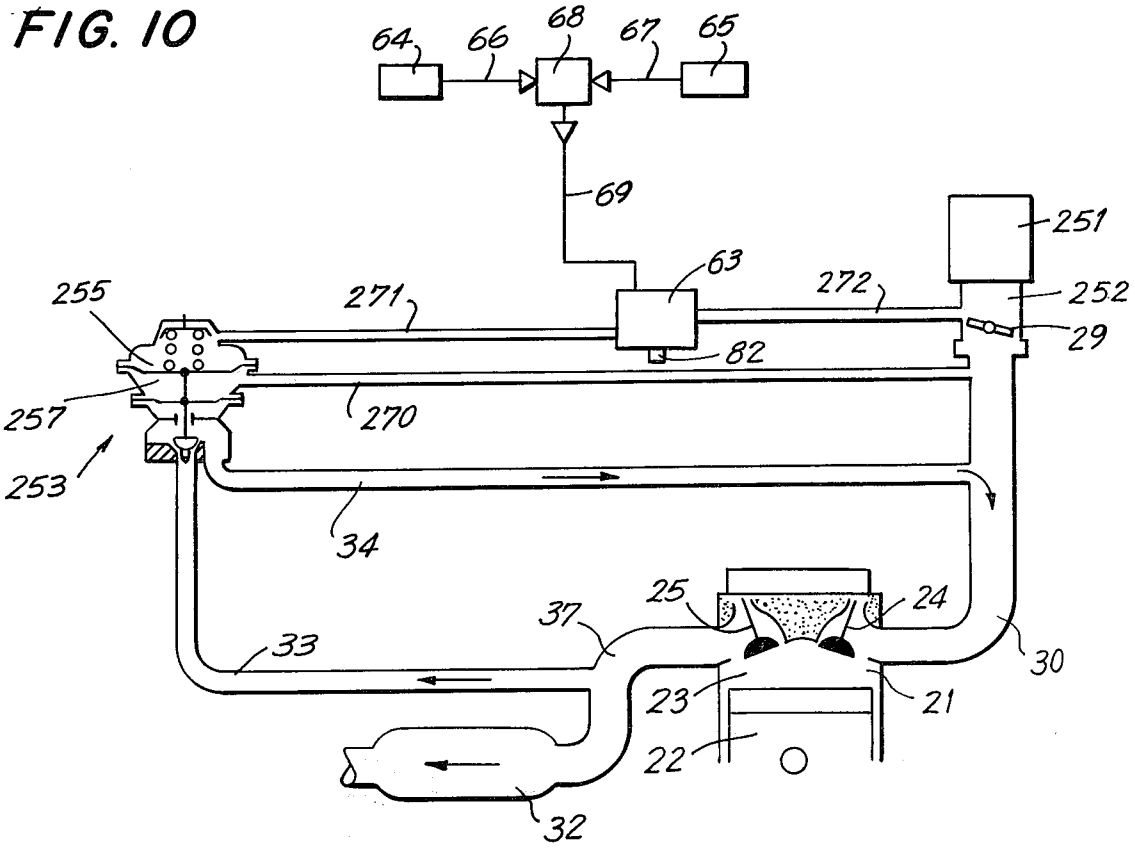
FIG. 10 is a schematic illustration of a seventh embodiment of the invention.

FIG. 10 schematically illustrates another embodiment of the invention for an internal combustion engine with a balanced pressure carburetor 251, in which there is present in a chamber 252 upstream of the dosing installation 29 during all operating conditions, a reduced pressure of approximately constant level.

The described components of the internal combustion engine herein are in accordance with the above described FIG. 3, so as to require no further detailed explanation. Within the flow path of conduits 33 and 34 there is positioned an adjusting device 253 which is more closely described in FIG. 11.

Figure 11:
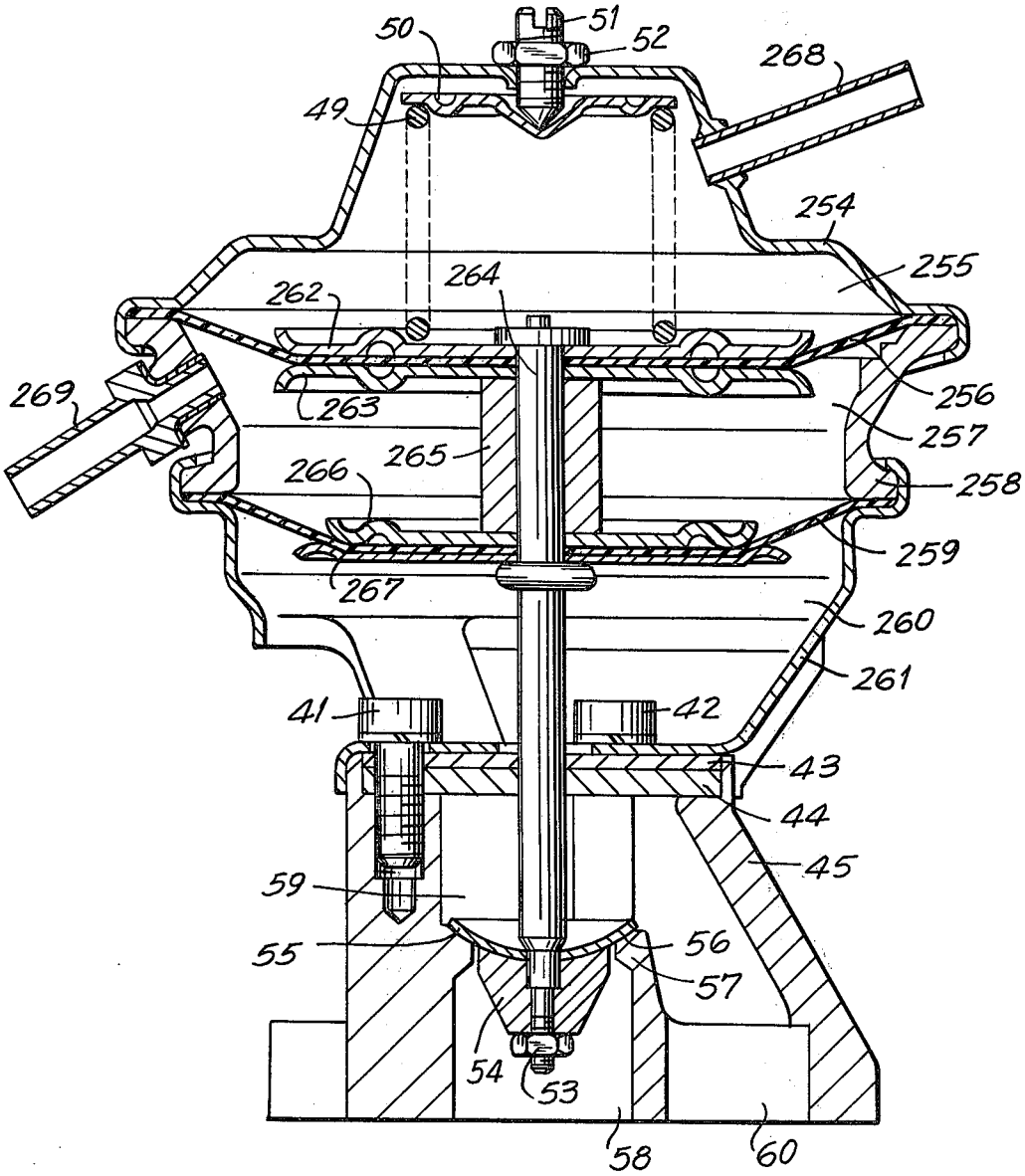
FIG. 11 is an enlarged sectional view of an inventive adjusting device utilized in the engine shown in FIG. 10.

According to FIG. 11, a membrane housing 254 encompasses a control pressure chamber 255 which is downwardly closed by means of a control membrane 256. Below control membrane 256 there is located a control pressure chamber 257 which is enclosed by a cast iron housing 258. The control pressure chamber 257 is downwardly closed by a second control membrane 259. Below the control membrane 259 there is located an atmospherically vented reference pressure chamber 260 which is encased by a sheet metal housing 261. The upper rim of the sheet metal housing 261 clampingly engages the periphery of control membrane 259, and the lower rim of cast iron housing 258. The rim of membrane housing 54 clampingly engages the periphery of control membrane 256, and the upper rim of the cast iron housing 258. The control membrane 256 has a larger active surface than the control membane 259.

Through the intermediary of screws 41 and 42, and after insertion of seal 43 and guide plate 44, sheet metal housing 261 is connected with cast iron housing 45, the latter of which serves as the valve housing.

The control membrane 256 is connected with membrane disc 262 and 263, and with a membrane rod 264. Through a distance sleeve 265, the components 256, 262, 263 and 264 are rigidly and undetachably connected with the second control membrane 259 and its membrane discs 266 and 267.

To the lower end of membrane rod 264, by means of a nut 53, there is fastened a valve cone which is constituted of two portions 54 and 55. The valve cone portion 55 has a spherical or curved upper surface and is movably supported. In its closed position it precisely fits against the edge 56 of an aperture 57.

Upstream of the valve cone there is located an inlet aperture 58, and downstream the collecting chamber 59 having an outlet aperture 60. A conduit connection 258 leads outwardly from the control pressure chamber 255, and a conduit connection 269 leads outwardly from the control pressure chamber 257. Interiorly of membrane housing 254 there is located a membrane spring 49 which is supported downwardly against a membrane disc 262 and upwardly against a spring contact plate 50. The pretensioning of the membrane spring 49 is adjustably carried out by means of an adjusting screw 51 which is secured by a lock nut 52.

In accordance with FIG. 10, a control conduit 270 leads from the control pressure chamber 257 of the adjusting device 253 to the section of the intake conduit 30 which is located downstream of the dosing installation 29. A further control conduit 271 leads from the control pressure chamber 255 to the multiple-position valve 63, whose details have been described in FIG. 1. The multiple-position valve 63 itself is an electromagnetically-actuated adjusting device. The operating parameters therefor are supplied by the characteristic thermal conditions of the internal combustion engine sensed by the thermal sensor 64, and the characteristic mechanical conditions sensed by the switch 65. The switch 65 may also be an engine RPM counter.

The operating parameters which are changed into electrical quantities or impulses are transmitted through electrical conduits 66 and 67 to an electronic control device 68, processed therein, and then converted into electrical signals which are suitable for the actuation of the multiple-position valve 63, and are then transmitted to the multiple-position valve 63 through electrical conduit 69.

The signal processing of the electronic control device 68 is so arranged in connection with the switching and arrangement of the multiple-position valve 63, that the control pressure chamber 255 during engine idle operation, above the upper part-load range and during the full-load operation is vented through the control conduit 271 and outwardly leading conduit connection 82. During the lower and upper part-load engine operation, the control pressure chamber contrastingly is connected through control conduits 271 and 272 with the portion of the intake conduit 30 which is located downstream of the dosing installation 29. (In FIG. 10 the dosing installation is illustrated in a closed condition, so that the control conduit 275 opens upstream of the closed dosing installation 29).

During engine idle operation, the control pressure chamber 255 is vented. In comparison therewith a relatively low pressure reigns in the control pressure chamber 257. Since the upper control membrane 256 has a larger active upper surface than the lower control membrane 259, the valve cone remains closed in its at-rest position. Consequently, no reconveyance of the exhaust gas takes place.

During the lower and upper part-load engine operation, a differential pressure reigns on both sides of the control membrane 257 which results from the varied setting of the dosing installation 29 in which, however, the control pessure in the control pressure chamber 255 is constantly higher than that in the control pressure chamber 257. Next, notwithstanding the relatively low pressure in the control pressure chamber 257, the adjusting device 253 is only opened to a small extent. At increasing engine loads, the adjusting device 253 is increasingly opened notwithstanding the increasing pressure in the control pressure chamber 257, since the pressure differential reduces on both sides of the control membrane 256, and the active surface of the control membrane 256 is larger than the active surface of the control membrane 259.

Below the full-load engine operation, the adjusting device 253 finally is again increasingly closed, since the pressure in the suction conduit 40 approaches atmospheric pressure. During the full-load engine operation itself, the control pressure chamber 253 is vented so that the valve cone, independently of the pressure still present in the control pressure chamber 257, returns into its closed at-rest position.

This embodiment of the invention has the particular advantage that during part-load engine operation, an almost constant control pressure reigns in the control pressure chamber 255 of the adjusting device 253, so that no pessure accumulator is required. Also in this variation, the thermal sensor 64 in connection with the electronic control device 68 and the multiple-position valve 63, is in the position, independently of the particular operating condition of the internal combustion engine, to maintain the venting of the control pressure chamber 255 for so long and to interrupt the return flow of the exhaust gas, until the internal combustion engine exceeds a minimum temperature.

While there has been shown what is considered to be the preferred embodiment of the invention, it will be obvious that modifications may be made which come within the scope of the disclosure of the specification.

What is claimed is:

1. A control arrangement for the reconveyance of exhaust gas into an intake conduit of an internal combustion engine and including a dosing installation for a fuelair mixture in said intake conduit; comprising an adjusting device for determining the quantity of the reconveyed exhaust gas; a control conduit communicating with said adjusting device adapted to impart operating parameters thereto in response to a gas pressure present in said intake conduit; at least one control membrane in said adjusting device dividing the interior into separate control pressure chamber portions subjected to a differential pressure in response to said operating parameters; a control element fastened to said control membrane and adapted to be actuated thereby; a multiple-position valve being positioned in the flow path of said control conduit, said multiple-position valve being adapted to subject at least one of said control pressure chamber portions to a predetermined gas pressure for imparting control to said adjusting device over the flow of exhaust gas into said intake conduit; a second control membrane in said adjusting device in spaced relationship with and below said first control membrane and defining a control pressure chamber therebetween adapted to be subjected to a control pressure prevailing in the intake; means operatively connecting said first and second membranes; valve means in a reconveying line for influencing the quantity of reconveyed exhaust gas; said adjusting device having a control membrane connected to said valve means; the position of said multiple-position valve being dependent substantially on the position of the dosing installation in said intake; said control pressure chamber being bordered by said first control membrane and facing said second control membrane; said multiple-position valve being connected before the control pressure chambers; said membrane connecting means comprising a free-wheeling couplingmember adapted to facilitate relative movement between said first and second membranes.

2. A control arrangement as claimed in claim 1, comprising at least one pretensioned resilient spring means in said adjusting device communicating with each of said control membranes for biasing said device into a normally closed operative position.

3. A control arrangement as claimed in claim 1, said first control membrane having a larger active operative surface than the surface of said second control membrane.

4. A control arrangement as claimed in claim 1, said control pressure effective in the control pressure chamber between said first and second membranes being the pressure in said intake conduit downstream of said dosing installation, and the control pressure chamber portion located above said first control membrane being selectively subjected to the pressure upstream and downstream of said dosing installation.

5. A control arrangement as claimed in claim 1, said dosing installation comprising a multiple-position valve adapted to impart a selective pressure to the control pressure chamber portion above said first control membrane.

6. A control arrangement as defined in claim 1 including accumulator means and return valve means connected in series with said multiple position valve, the series combination of said multiple position valve, said accumulator means and said return valve means being connected between said adjusting device and said intake conduit; plate cam means; an actuating shaft on said dosing installation and fastened to said plate cam means; electrical switch means actuated by said cam means and electrically connected to said multiple position valve; thermal switch means connected in parallel with said first-mentioned switch means, said thermal switch means opening when the temperature of said engine exceeds a predetermined value; said control conduit means being connected between said adjusting device and said dosing installation; and auxiliary conduit means connected between said adjusting device and said intake conduit.

7. A control device for the feedback of exhaust gas into the intake line of a mixture compressing internal combustion engine having adjusting means for determining a quantity of fed-back exhaust gas, said adjusting means using as operating parameter a gas pressure present in the internal combustion engine, a control conduit for applying said gas pressure, said adjusting means having an adjusting element and control pressure chamber and comprising a first control diaphragm actuating said adjusting element, said control diaphragm dividing said chamber into sections in which a differential pressure caused by the operating parameter is active, a multiple-position valve located in the control conduit and arranged for applying selectively under-pressure or atmospheric pressure to one of said sections of said control pressure chamber, a second control diaphragm spaced from said first control diaphragm and connected to said first control diaphragm; a clutch having a free-wheeling device for connecting said second control diaphragm to said first control diaphragm; said first control diaphragm having a larger active area than said second control diaphragm; metering means in said intake; one of said sections of said control pressure chamber being located above said first control diaphragm and selectively receiving, at predetermined operating ranges of the internal combustion engines, pressure prevailing upstream or downstream from said metering means, pressure prevailing in the intake line downstream from said metering means being applicable to the section of the control pressure chamber located between said diaphragms; valve means in a reconveying line for influencing the quantity of reconveyed exhaust gas; said adjusting device having one of said control diaphragms connected to said valve means; the position of said multiple-position valve being dependent substantially on the position of said metering means in said intake; one of said sections said control pressure chamber being bordered by said first control diaphragm and facing said second control diaphragm; said multiple-position valve being connected before one of said sections of the control pressure chamber.

* * * * *